US006489931B2

(12) United States Patent
Liu

(10) Patent No.: US 6,489,931 B2
(45) Date of Patent: Dec. 3, 2002

(54) DIAGONAL DUAL-POLARIZED BROADBAND HORN ANTENNA

(75) Inventor: Kefeng Liu, Round Rock, TX (US)

(73) Assignee: EMC Test Systems, LP, Austin, TX (US)

( * ) Notice: Subject to any disclaimer, the term of this patent is extended or adjusted under 35 U.S.C. 154(b) by 0 days.

(21) Appl. No.: 09/746,964

(22) Filed: Dec. 21, 2000

(65) Prior Publication Data

US 2002/0080081 A1 Jun. 27, 2002

(51) Int. Cl.[7] ..... H01Q 13/00
(52) U.S. Cl. ..... 343/786; 343/703
(58) Field of Search ..... 343/703, 772, 343/783, 786; H01Q 13/00, 13/02

(56) References Cited

U.S. PATENT DOCUMENTS

| | | | | | |
|---|---|---|---|---|---|
| 3,696,434 | A | * | 10/1972 | Sciambi | 343/776 |
| 3,714,652 | A | * | 1/1973 | Grabowski et al. | 343/786 |
| 4,141,013 | A | * | 2/1979 | Crail et al. | 343/756 |
| 4,757,326 | A | * | 7/1988 | Profera | 343/786 |
| 4,775,867 | A | * | 10/1988 | Sokol et al. | 343/786 |
| 4,788,553 | A | * | 11/1988 | Phillips | 343/786 |
| 4,811,028 | A | * | 3/1989 | Bryanos | 343/786 |

* cited by examiner

*Primary Examiner*—Tho Phan

(74) *Attorney, Agent, or Firm*—Akin, Gump, Strauss, Hauer & Feld, LLP

(57) ABSTRACT

A diagonal dual-polarized broadband horn antenna. The unique use of diagonal line ridges placed in the corners of the aperture of the diagonal dual-polarized broadband horn antenna. The sides of the diagonal dual-polarized broadband horn antenna are made of any number of materials including dielectric material or metallic material. The operating frequency range of one embodiment of the present invention is approximately 100 MHz to 18 GHz in one embodiment. The present invention is scaleable to allow operation at even higher and lower frequencies. This ability of the present invention to adapt to a number of frequency ranges allows application for a wide variety of electromagnetic testing applications. The use of the diagonal line ridges allows for a broadband horn antenna that is significantly more manageable that conventional broadband horn antennas, while offering operation at common frequency ranges. Moreover, the unique use of the diagonal line ridges provides for operation at the lower ends of the frequency spectrum without requiring the radical increase in size that conventional broadband horn antenna approaches require. The present invention allows for use of any number of tuning bars to focus the frequencies emitted from a diagonal dual-polarized broadband horn antenna into a common direction. The use of the present invention is operable to perform electromagnetic testing of any number of devices including wireless communication devices, wireless appliances, satellite communication devices, and other devices.

18 Claims, 8 Drawing Sheets

(Side View)

(Top View)

(Side View)

(Top View)

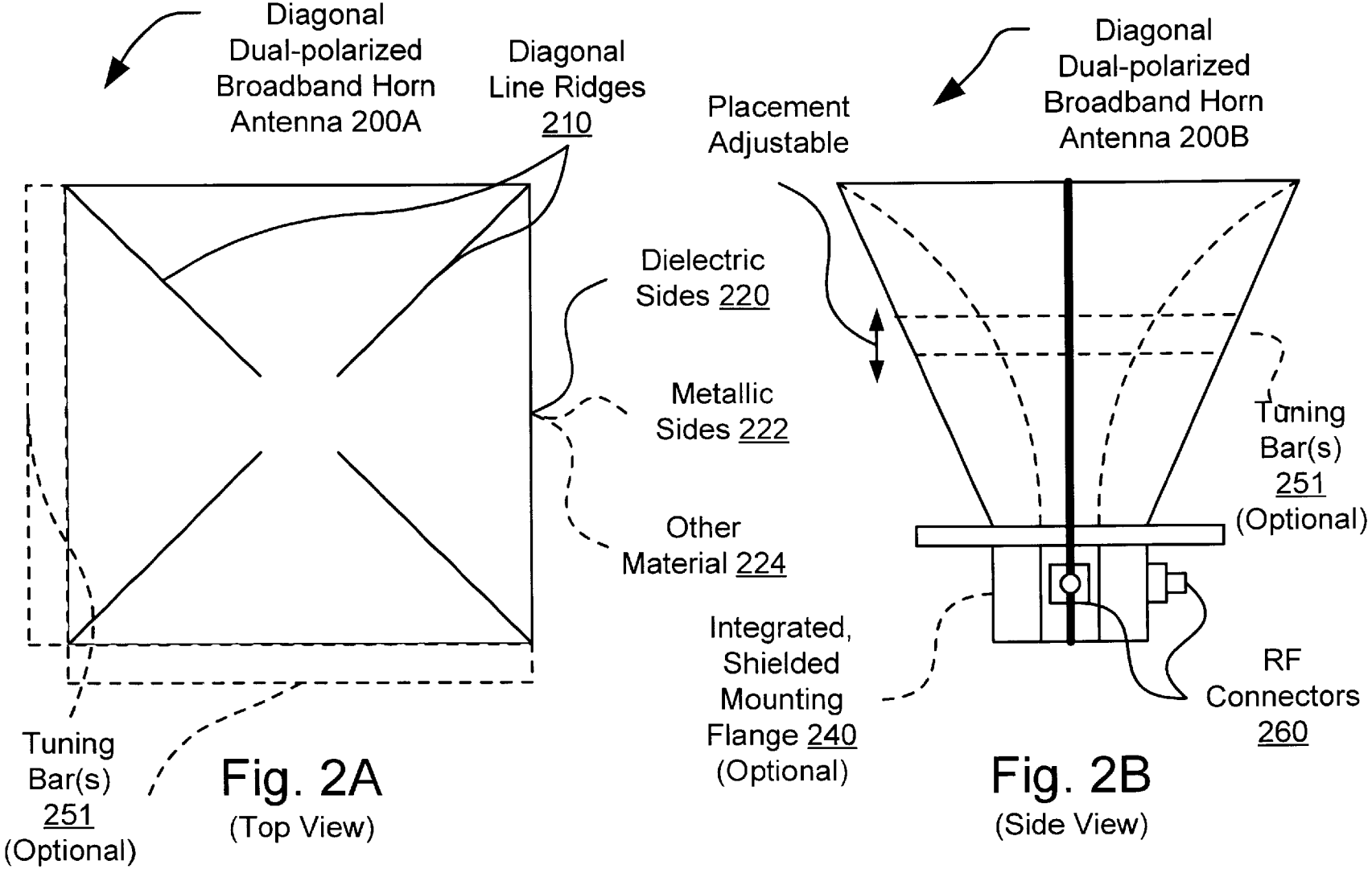
Fig. 2B (Side View)
Fig. 2A (Top View)

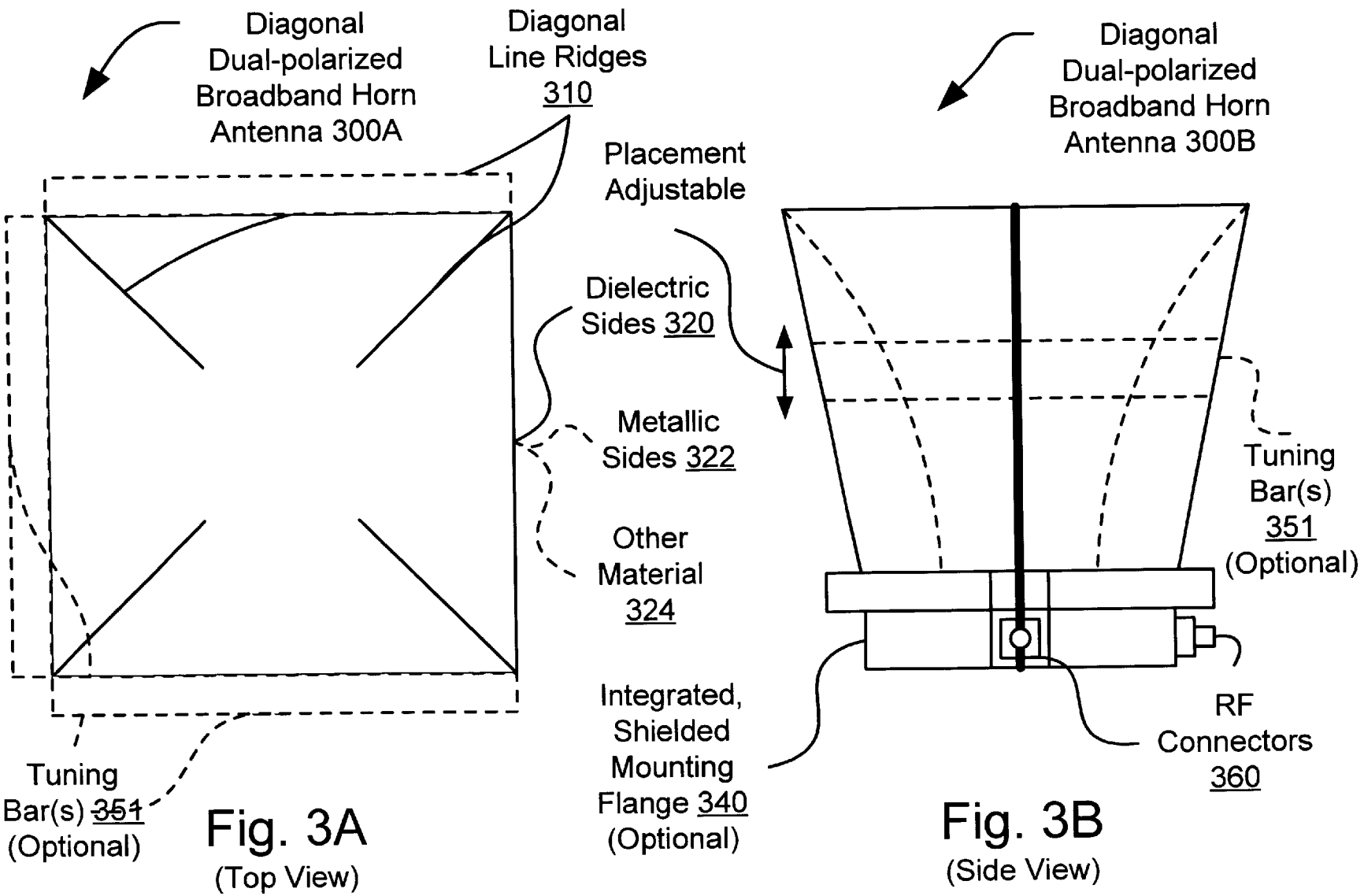
Fig. 3B (Side View)
Fig. 3A (Top View)

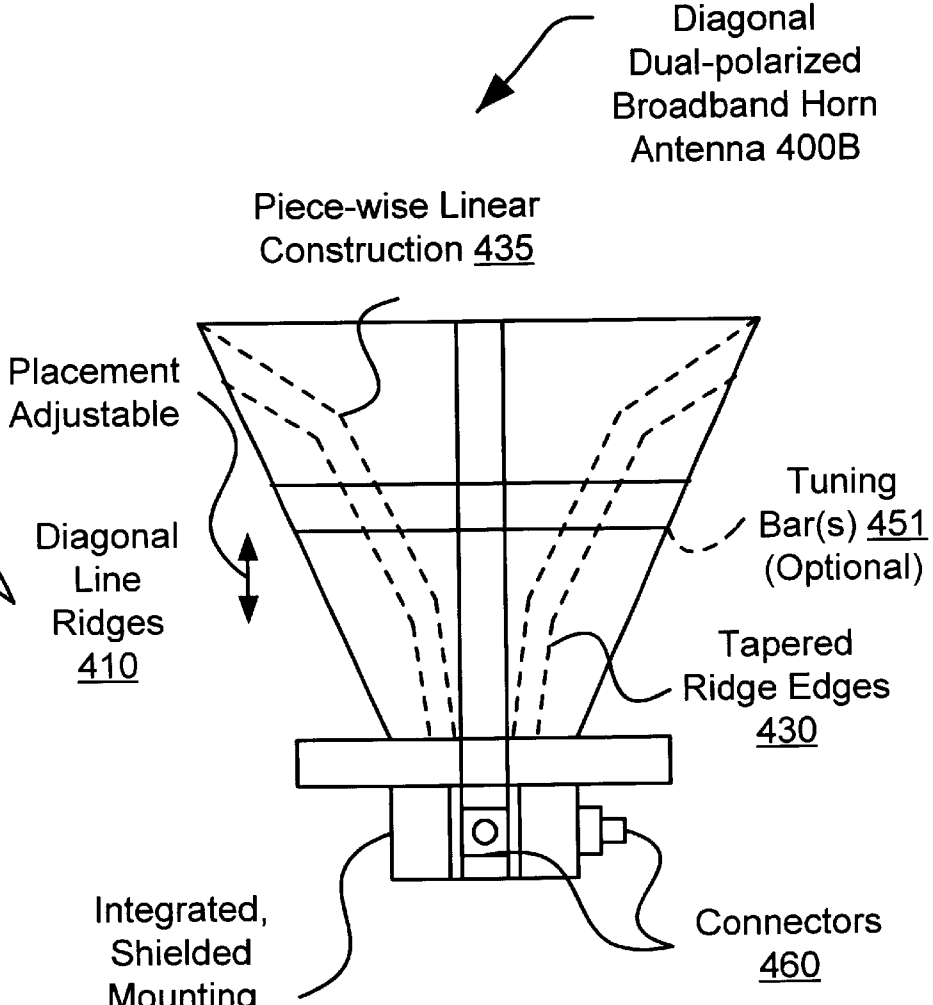
Fig. 4B (Side View)
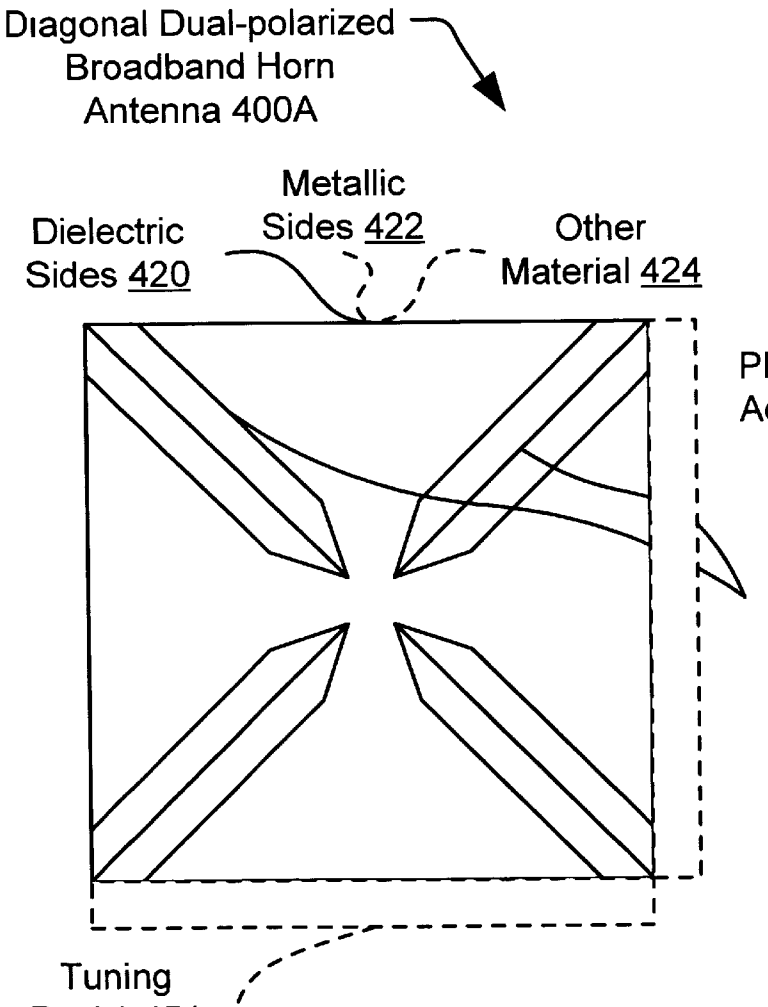
Fig. 4A (Top View)

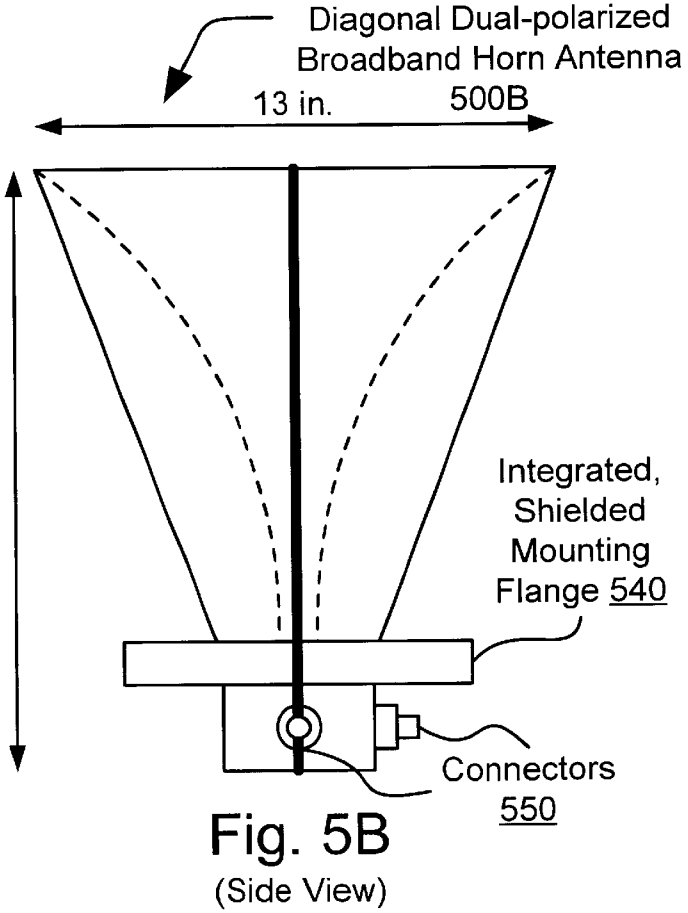

Fig. 5B
(Side View)

Physical Specifications
Length (Overall): 20 in.
Width (Aperature): 13 in.
Length (Aperature): 13 in.
Weight (Overall): 20 lbs.

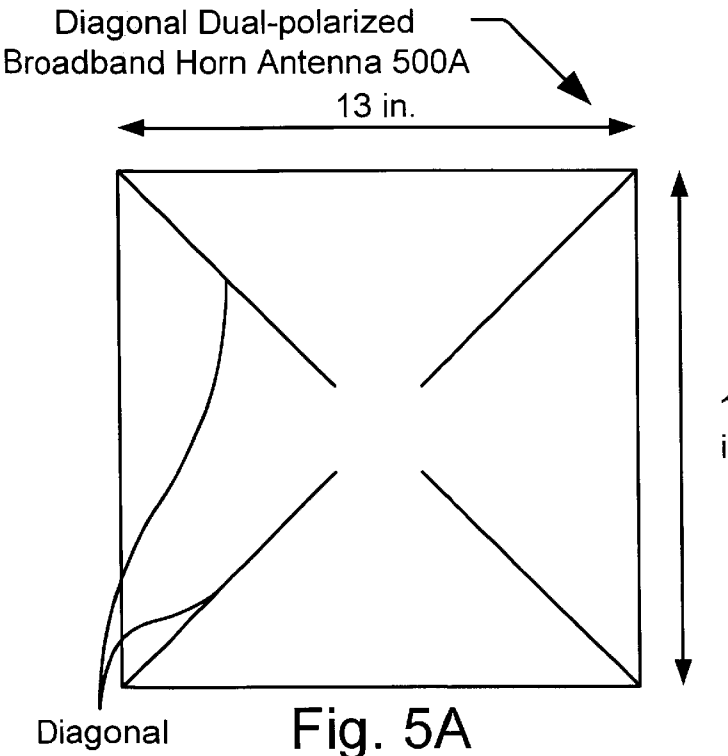

Fig. 5A
(Top View)

Electrical Specifications
Freq. Range: 400 MHz - 6 GHz
VSWR Ratio (AVG): < 2.5:1
Directivity Gain Over Operating Freq.: 5 dBi - 18 dBi
Cross-polarization Isolation: > 25 dB
Maximum Continuous Power: 200W
Impedance (Nominal): 50 Ohms
Connector: SMA(2)
Dual Polarization Symmetry: +/- 0.1 dB

DIAGONAL DUAL-POLARIZED BROADBAND HORN ANTENNA

BACKGROUND

1. Technical Field

The present invention relates generally to antennas; and, more particularly, it relates to a diagonal dual-polarized broadband horn antenna.

2. Related Art

Conventional broadband horn antennas used in electromagnetic test systems are commonly limited in operating frequency ranges of approximately 500 MHz to 18 GHz. Generally speaking, linear dimensions of a conventional antenna vary inversely with the operating frequency range. To try to operate at much lower frequency ranges, a conventional approach has been to increase the overall size of a horn antenna. This has proven to be very difficult in terms of implementation. For example, the size constraints of a horn antenna, for proper use in a test system, are considerable. In addition, as the size of a horn antenna increases, thereby allowing a lower operating frequency range, the weight of the horn antenna also increases. This also encumbers the ease with which the horn antenna is used in various electromagnetic test systems. The size, weight, and bulkiness of existing horn antennas are all considerations that limit their ease of implementation for use in test systems. Moreover, there is no easy way in which these conventional horn antennas can be mounted within existing shielded test chambers as part of the shielded enclosure. Additional manufactured fixtures or positioners must be made in order to integrate the horn antenna into the test chamber. Sometimes, these additional fixtures to the horn antenna may compromise the overall performance of the test system by the presence of additional unwanted signals introduced by them.

There are primarily two approaches known in the art of manufacturing broadband horn antennas under the conventional approach. FIGS. 1A–1D show prior art implementations of broadband horn antennas. FIG. 1A is a system diagram illustrating a conventional embodiment of a square broadband horn antenna 100A, and FIG. 1B is another perspective of the square broadband horn antenna 100B of the FIG. 1A. Line ridges 110 are aligned along the side wall segments of the square broadband horn antenna 100A. The sides of the square broadband horn antenna 100A (and the square broadband horn antenna 100B) are commonly metallic sides 120 as known in the art of electromagnetic testing. Connectors 130 are provided to energize the square broadband horn antenna 100A (and the square broadband horn antenna 100B). To allow operating lower operational frequency ranges, the size of the aperture of the size of the square broadband horn antenna 100A (and the square broadband horn antenna 100B) must be increased accordingly.

As mentioned above, the sizes of most conventional broadband horn antennas generally limits their lower end of the operating frequency ranges to approximately 500 MHz given the considerations of having a size that allows practical emplacement, removal, and modification of test facilities to accommodate them. While the conventional designs of broadband horn antennas is theoretically scalable to accommodate lower frequency operating ranges, the actual scaling of broadband horn antennas to larger sizes that allow for this type of operation presents other impediments that simply make such large broadband horn antenna designs. For example, the large and bulky size significantly encumbers movement of the broadband horn antenna to such a degree that their use in a test facility where interchange of test devices, the absorbers used in the test facility, and the broadband horn antennas themselves, can be commonplace. Moreover, the weight of such large and bulky broadband horn antennas additionally encumbers their use for lower operating frequency ranges.

FIG. 1C is a system diagram illustrating a conventional embodiment of a circle broadband horn antenna 100C, and FIG. 1D is another perspective of the circle broadband horn antenna 100C of the FIG. 1C. Line ridges 140 are aligned along the interior of the circle broadband horn antenna 100C. The sides of the circle broadband horn antenna 100C (and the circle broadband horn antenna 100D) are commonly metallic sides 150 as known in the art of electromagnetic testing. Connectors 160 are provided to energize the circle broadband horn antenna 100C (and the circle broadband horn antenna 100D). To allow operating lower operational frequency ranges, the size of the aperture of the size of the circle broadband horn antenna 100C (and the circle broadband horn antenna 100D) must be increased accordingly, as mentioned above in square embodiments of conventional broadband horn antennas. The many deficiencies of the square embodiments are equally applicable with respect to the circle embodiments of broadband horn antennas. In addition, the manufacturing complexity of the circular broadband horns results in much higher cost of this particular broadband horn antenna that is designed to operate at lower operating frequencies. As a result, the available commercial product of this type of horn is limited to operating frequencies above 2 GHz. The lower frequency ranges simply cannot be met using this design.

Further limitations and disadvantages of conventional and traditional systems will become apparent to one of skill in the art through comparison of such systems with the present invention as set forth in the remainder of the present application with reference to the drawings.

SUMMARY OF THE INVENTION

Various aspects of the present invention can be found in a diagonal dual-polarized broadband horn antenna. The diagonal dual-polarized broadband horn antenna includes, among other things, a square cavity having a number of corners, a diagonal line ridge located at one of 5 the corners, and a number of electrical connectors, mounted on the diagonal dual-polarized broadband horn antenna, that receive a signal that is used to energize the diagonal line ridge to generate electromagnetic illumination.

In certain embodiments of the invention, more than one diagonal line ridge is employed. The diagonal dual-polarized broadband horn antenna also includes a tuning bar, mounted on the square cavity, that is operable to improve matching conditions of frequencies emanating from the diagonal dual-polarized broadband horn antenna in a common direction. More than one tuning bar is used in some embodiments of the inventions. The square cavity is made of any number of materials including a dielectric material and a metallic material. One, some, or all of the electrical connectors is a radio frequency connector. The diagonal dual-polarized broadband horn antenna also includes an integrated, shielded mounting flange located at an end of the diagonal dual-polarized broadband horn antenna. The diagonal line ridge has any number of shapes including a smooth shape. The diagonal dual-polarized broadband horn antenna is operable for installation on a shield line of a shielded anechoic test chamber among other types of test chambers types.

Other aspects of the present invention can be found in a diagonal dual-polarized broadband horn antenna. The diagonal dual-polarized broadband horn antenna includes, among other things, an aperture having a corner, and a diagonal line ridge that is positioned at the corner.

In certain embodiments of the invention, the aperture further also includes three additional corners and three additional diagonal line ridges. Each of the three additional diagonal line ridges is positioned at one of the three additional comers. The diagonal line ridge is of any number of types of shapes including a tapered ridge shape. The diagonal dual-polarized broadband horn antenna also includes a cavity and a tuning bar. The tuning bar is mounted on the cavity and is operable to improve matching conditions for frequencies emanating from the diagonal dual-polarized broadband horn antenna in a common direction. More than one tuning bar is used in some embodiments of the inventions. The diagonal dual-polarized broadband horn antenna also includes at least two input feeds, on the mounting flange, that are operable to permit simultaneous measurements for dual polarizations emanating from the diagonal dual-polarized broadband horn antenna. The diagonal dual-polarized broadband horn antenna also includes a cavity that is made of any number of materials including a dielectric material and a metallic material. The diagonal dual-polarized broadband horn antenna is operable for installation on a shield line of a shielded anechoic test chamber among other types of test chambers types.

Other aspects of the present invention can be found in a diagonal dual-polarized broadband horn antenna. The diagonal dual-polarized broadband horn antenna includes a square cavity, a mounting flange coupled to the square cavity, and two input feeds, on the mounting flange, that are operable to permit simultaneous measurements for dual polarizations emanating from the diagonal dual-polarized broadband horn antenna.

In certain embodiments of the invention, the diagonal dual-polarized broadband horn antenna is operable to generate electromagnetic illumination having a frequency range of approximately 100 MHz to approximately 18 GHz. The square cavity includes a number of corners and a number of diagonal line ridges. Each of the diagonal line ridges is positioned at one of the comers. The square cavity is made of any number of materials including a dielectric material. The diagonal dual-polarized broadband horn antenna also includes a tuning bar, mounted on the square cavity, that is operable to improve a matching condition for frequencies emanating from the diagonal dual-polarized broadband horn antenna in a common direction. More than one tuning bar is used in some embodiments of the inventions. The diagonal dual-polarized broadband horn antenna is operable for installation on a shield line of a shielded anechoic test chamber among other test chamber types.

Other aspects, advantages and novel features of the present invention will become apparent from the following detailed description of the invention when considered in conjunction with the accompanying drawings.

BRIEF DESCRIPTION OF THE DRAWINGS

A better understanding of the present invention can be obtained when the following detailed description of various exemplary embodiments are considered in conjunction with the following drawings.

FIG. 2A is a system diagram illustrating an embodiment of a diagonal dual-polarized broadband horn antenna built in accordance with the present invention.

FIG. 2B is a system diagram illustrating another perspective of the diagonal dual-polarized broadband horn antenna of the FIG. 2A.

FIG. 3A is a system diagram illustrating another embodiment of a diagonal dual-polarized broadband horn antenna built in accordance with the present invention.

FIG. 3B is a system diagram illustrating another perspective of the diagonal dualpolarized broadband horn antenna of the FIG. 3A.

FIG. 4A is a system diagram illustrating another embodiment of a diagonal dual-polarized broadband horn antenna built in accordance with the present invention.

FIG. 4B is a system diagram illustrating another perspective of the diagonal dual-polarized broadband horn antenna of the FIG. 4A.

FIG. 5A is a system diagram illustrating another embodiment of a diagonal dual-polarized broadband horn antenna built in accordance with the present invention.

FIG. 5B is a system diagram illustrating another perspective of the diagonal dual-polarized broadband horn antenna of the FIG. 4A.

DETAILED DESCRIPTION OF THE INVENTION

Figure 1B:
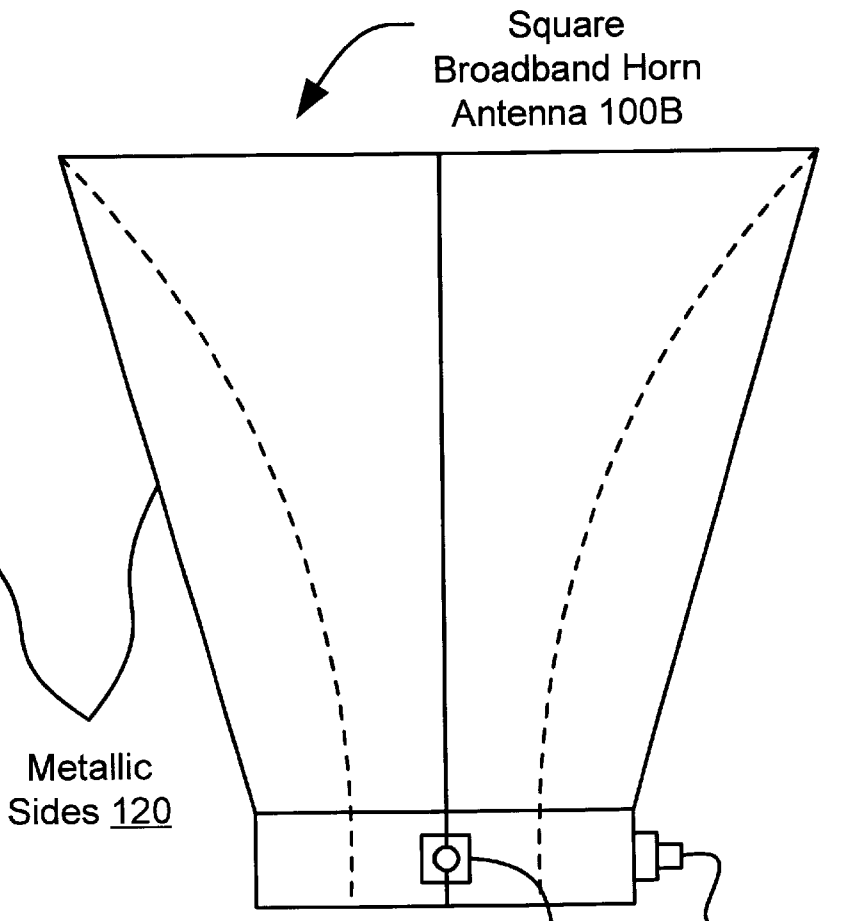
Fig. 1B Prior Art
FIGS. 1A–1D show prior art implementations of broadband horn antennas.
Figure 1A:
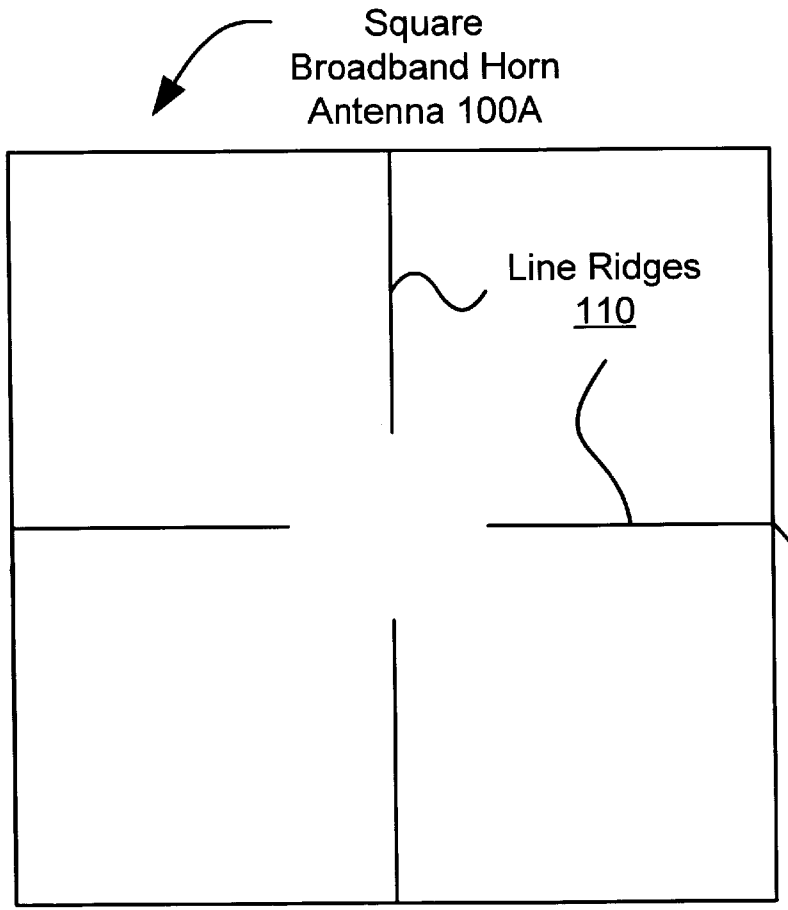
Fig. 1A Prior Art
Figure 1D:
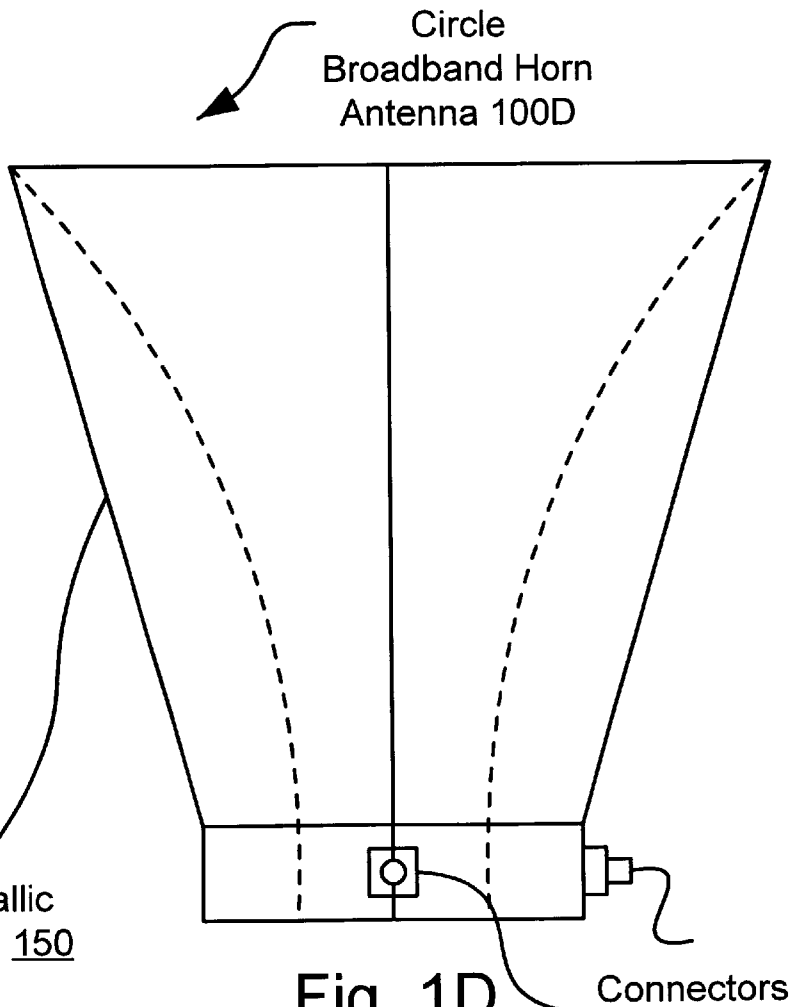
Fig. 1D Prior Art
Figure 1C:
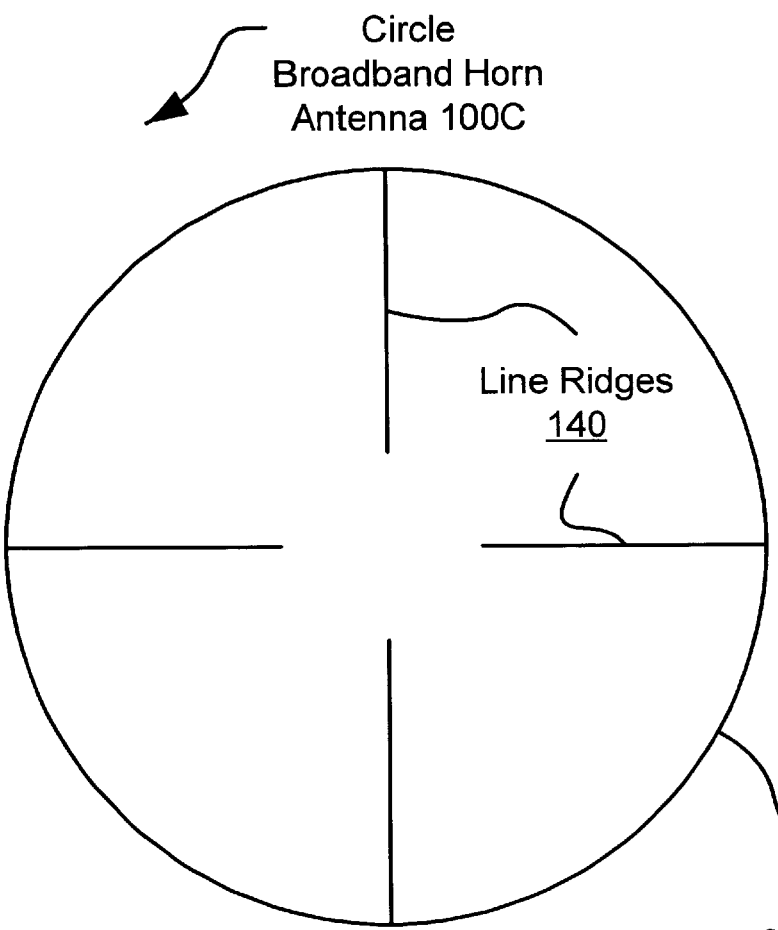
Fig. 1C Prior Art

FIG. 2A is a system diagram illustrating an embodiment of a diagonal dual-polarized broadband horn antenna 200A built in accordance with the present invention. Inside of the square cavity of the diagonal dual-polarized broadband horn antenna 200A has diagonal line ridges 210 extending from the corners of the diagonal dual-polarized broadband horn antenna 200A. The diagonal dual-polarized broadband horn antenna 200A contains a cavity that contains the diagonal line ridges 210. From certain perspectives, the cavity is a square. Moreover, the cavity is viewed as having a number of corners. In addition, tuning bars 251 are used in certain embodiments of the invention to control the directional tuning of electo-magnetic illumination generated by the diagonal dual-polarized broadband horn antenna 200A. The optional tuning bars 251 are used to focus all of the frequencies into a common direction. The sides of the diagonal dual-polarized broadband horn antenna 200A, in contrast to a conventional broadband horn antenna, are made of any number of materials. The diagonal dual-polarized broadband horn antenna 200A includes dielectric sides 220 in one embodiment. The diagonal dual-polarized broadband horn antenna 200A includes metallic sides 222 or sides of any other material 224 in other embodiments. As shown in the FIG. 2A, the tuning bars 251 are aligned along only two sides of the diagonal dual-polarized broadband horn antenna 200A. However, this illustration is exemplary of one particular embodiment of tuning bars 251 used within a diagonal dual-polarized broadband horn antenna. In other embodiments, other tuning bars are placed along all four sides of a diagonal dual-polarized broadband horn antenna or along other of the four sides of the diagonal dual-polarized broadband horn antenna 200A shown in the FIG. 2A.

FIG. 2B is a system diagram illustrating another perspective of the diagonal dual-polarized broadband horn antenna 200A of the FIG. 2A, shown in the FIG. 2B as a diagonal dual-polarized polarized broadband horn antenna 200B. As shown in the FIG. 2B, placement of the tuning bars 251 is adjustable along the length of the length of the cavity of the diagonal dual-polarized broadband horn antenna 200B. Another feature offered by the diagonal dual-polarized broadband horn antenna 200B, in contrast to conventional broadband horn antennas used in the art, is the availability of an integrated, shielded mounting flange 240. Electrical connections, shown as the radio frequency (RF) connectors 260, allow the diagonal dual-polarized broadband horn antenna 200B to be energized to generate electromagnetic illumination within a test facility. In certain embodiments of the invention, the RF connectors 260 themselves are orthogonally aligned to allow simultaneous measurements for dual polarizations. The integrated, shielded mounting flange 240 allows the diagonal dual-polarized broadband horn antenna 200A (and the diagonal dual-polarized broadband horn antenna 200B) to be installed with relative ease within a test chamber or test facility. In addition, the unique design of the diagonal dual-polarized broadband horn antenna 200A (and the diagonal dual-polarized broadband horn antenna 200B), having the line ridges 210 located at the corners of the diagonal dual-polarized broadband horn antenna 200A (and the diagonal dual-polarized broadband horn antenna 200B), allows for operation at significantly lower operating frequency ranges when compared to conventional broadband horn antennas. One particular example of dimensions of a diagonal dual-polarized broadband horn antenna built in accordance with the present invention will be discussed in more detail below.

FIG. 3A is a system diagram illustrating another embodiment of a diagonal dual-polarized broadband horn antenna 300A built in accordance with the present invention. The diagonal dual-polarized broadband horn antenna 300A also has diagonal line ridges 310 extending from the corners of the diagonal dual-polarized broadband horn antenna 300A. In addition, tuning bars 351 are used in certain embodiments of the invention to control the directional tuning of electo-magnetic illumination generated by the diagonal dual-polarized broadband horn antenna 300A. The optional tuning bars 351 can similarly be used to focus all of the frequencies generated by the diagonal dual-polarized broadband horn antenna 300A into a common direction. The sides of the diagonal dual-polarized broadband horn antenna 300A, in contrast to a conventional broadband horn antenna, are made of any number of materials. The diagonal dual-polarized broadband horn antenna 300A includes dielectric sides 320 in one embodiment. The diagonal dual-polarized broadband horn antenna 300A includes metallic sides 322 or sides of any other material 324 in other embodiments. As shown in the FIG. 3A, the tuning bars 351 are aligned along three sides of the diagonal dual-polarized broadband horn antenna 300A. However, this illustration is exemplary of one particular embodiment of tuning bars 351 used within a diagonal dual-polarized broadband horn antenna. In other embodiments, other tuning bars are placed along all four sides of a diagonal dual-polarized broadband horn antenna or along other of the four sides of the diagonal dual-polarized broadband horn antenna 300A shown in the FIG. 3A.

FIG. 3B is a system diagram illustrating another perspective of the diagonal dual-polarized broadband horn antenna 300A of the FIG. 3A, shown in the FIG. 3B as a diagonal dual-polarized broadband horn antenna 300B. As shown in the FIG. 3B, placement of the tuning bars 351 is adjustable along the length of the length of the cavity of the diagonal dual-polarized broadband horn antenna 300B. Another feature offered by the diagonal dual-polarized broadband horn antenna 300B, in contrast to conventional broadband horn antennas used in the art, is the availability of an integrated, shielded mounting flange 340. Electrical connections, shown as the radio frequency (RF) connectors 360, allow the diagonal dual-polarized broadband horn antenna 300B to be energized to generate electromagnetic illumination within a test facility. In certain embodiments of the invention, the RF connectors 360 themselves are orthogonally aligned to allow simultaneous measurements for dual polarizations. The integrated, shielded mounting flange 340 allows the diagonal dual-polarized broadband horn antenna 300A (and the diagonal dual-polarized broadband horn antenna 300B) to be installed with relative ease within a test chamber or test facility. In addition, the unique design of the diagonal dual-polarized broadband horn antenna 300A (and the diagonal dual-polarized broadband horn antenna 300B), having the line ridges 310 located at the corners, allows for operation at significantly lower operating frequency ranges when compared to conventional broadband horn antennas. Again, as mentioned above, one particular example of dimensions of a diagonal dual-polarized broadband horn antenna built in accordance with the present invention will be discussed in more detail below.

FIG. 4A is a system diagram illustrating another embodiment of a diagonal dual-polarized broadband horn antenna 400A built in accordance with the present invention. The diagonal dual-polarized broadband horn antenna 400A also has diagonal line ridges 410 extending from the corners of the diagonal dual-polarized broadband horn antenna 400A. In this particular embodiment, the diagonal line ridges 410 are have tapered ridge edges 451 (as shown again in a FIG. 4B). Moreover, the shape of the diagonal line ridges 410 includes a piece-wise linear construction 435 (as shown again in the FIG. 4B). The embodiment of a diagonal dual-polarized broadband horn antenna shown in the FIG. 4A stresses the point that the particular shape, placement, and size of diagonal line ridges within a diagonal dual-polarized broadband horn antenna are able to be modified without significantly affecting the performance of the diagonal dual-polarized broadband horn antenna. Oftentimes a diagonal dual-polarized broadband horn antenna having diagonal line ridges 410 having piece-wise linear construction 435 is more easily constructed than a diagonal dual-polarized broadband horn antenna having diagonal line ridges having a smooth construction. At any rate, it is clear that the particular choices of degree of curvature, particular shape of line ridges, and even the shape of the line ridges are all design considerations that may be modified without departing from the scope and spirit of the invention.

In addition, tuning bars 451 are used in certain embodiments of the invention to control the directional tuning of electo-magnetic illumination generated by the diagonal dual-polarized broadband horn antenna 400A. The optional tuning bars 451 can similarly be used to focus all of the frequencies generated by the diagonal dual-polarized broadband horn antenna 400A into a common direction. The sides of the diagonal dual-polarized broadband horn antenna 400A, in contrast to a conventional broadband horn antenna, are made of any number of materials. The diagonal dual-polarized broadband horn antenna 400A includes dielectric sides 420 in one embodiment. The diagonal dual-polarized broadband horn antenna 400A includes metallic sides 422 or sides of any other material 424 in other embodiments. As shown in the FIG. 4A, the tuning bars 451 are aligned along two sides of the diagonal dual-polarized broadband horn antenna 400A. However, this illustration is exemplary of one particular embodiment of tuning bars 451 used within a diagonal dual-polarized broadband horn antenna. In other embodiments, other tuning bars are placed along all four sides of a diagonal dual-polarized broadband horn antenna or along other of the four sides of the diagonal dual-polarized broadband horn antenna 400A shown in the FIG. 4A.

FIG. 4B is a system diagram illustrating another perspective of the diagonal dual-polarized broadband horn antenna 400A of the FIG. 4A, shown in the FIG. 4B as a diagonal dual-polarized broadband horn antenna 400B. As shown in the FIG. 4B, placement of the tuning bars 451 is adjustable along the length of the length of the cavity of the diagonal dual-polarized broadband horn antenna 400B. Another feature offered by the diagonal dual-polarized broadband horn antenna 400B, in contrast to conventional broadband horn antennas used in the art, is the availability of an integrated, shielded mounting flange 440. Electrical connections, shown as the connectors 460, allow the diagonal dual-polarized broadband horn antenna 400B to be energized to generate electromagnetic illumination within a test facility. In certain embodiments of the invention, the connectors 460 themselves are orthogonally aligned to allow simultaneous measurements for dual polarizations. While RF connectors 260 and 360 are shown in the embodiments of the invention illustrated in the FIGS. 2A, 2B, 3A, and 3B, any number of different types of connectors 460 are used in various embodiments of the invention as shown in the FIG. 4B. The integrated, shielded mounting flange 440 allows the diagonal dual-polarized broadband horn antenna 400A (and the diagonal dual-polarized broadband horn antenna 400B) to be installed with relative ease within a test chamber or test facility. In addition, the unique design of the diagonal dual-polarized broadband horn antenna 400A (and the diagonal dual-polarized broadband horn antenna 400B), having the line ridges 410 located at the corners, allows for operation at significantly lower operating frequency ranges when compared to conventional broadband horn antennas. Again, as mentioned above, one particular example of dimensions of a diagonal dual-polarized broadband horn antenna built in accordance with the present invention will be discussed in more detail below.

FIG. 5A is a system diagram illustrating another embodiment of a diagonal dual-polarized broadband horn antenna 500A built in accordance with the present invention. The diagonal dual-polarized broadband horn antenna 500A has diagonal line ridges 510 extending from the corners of the diagonal dual-polarized broadband horn antenna 500A. FIG. 5B is a system diagram illustrating another perspective of the diagonal dual-polarized broadband horn antenna 500A of the FIG. 5A, shown in the FIG. 5B as a diagonal dual-polarized broadband horn antenna 500B. A feature offered by the diagonal dual-polarized broadband horn antenna 500B is the availability of an integrated, shielded mounting flange 540. Electrical connections, shown as the connectors 550, allow the diagonal dual-polarized broadband horn antenna 500B to be energized to generate electromagnetic illumination. As mentioned above, this electromagnetic illumination is within a test facility or test chamber in certain embodiments of the invention. The electromagnetic illumination is free space in other embodiments. The integrated, shielded mounting flange 540 allows the diagonal dual-polarized broadband horn antenna 500A (and the diagonal dual-polarized broadband horn antenna 500B) to be installed with relative ease within a test chamber or test facility. In addition, the unique design of the diagonal dual-polarized broadband horn antenna 500A (and the diagonal dual-polarized broadband horn antenna 500B), having the line ridges 510 located at the corners, allows for operation at significantly lower operating frequency ranges when compared to conventional broadband horn antennas. A particular example of dimensions of a diagonal dual-polarized broadband horn antenna built in accordance with the present invention is presented immediately below in more detail.

The aperture dimensions of the diagonal dual-polarized broadband horn antenna 500A (and the diagonal dual-polarized broadband horn antenna 500B) are approximately 13 inches×13 inches. An overall length of the diagonal dual-polarized broadband horn antenna 500A (and the diagonal dual-polarized broadband horn antenna 500B) is approximately 20 inches, and the overall weight is approximately 20 pounds. The electrical specifications of the diagonal dual-polarized broadband horn antenna 500A (and the diagonal dual-polarized broadband horn antenna 500B) include operation at a frequency range of approximately 400 MHz to 6 GHz. The diagonal dual-polarized broadband horn antenna 500A (and the diagonal dual-polarized broadband horn antenna 500B) is also scaleable to larger sizes allowing operation at even lower operating frequency ranges. Another embodiment of the present invention is designed to operate at frequency ranges approaching as low as 100 MHz, thereby allowing testing of a number of wireless communication devices including cellular telephones, wireless computing applications, satellite communication applications, and any number of wireless appliances that operate at these lower frequency ranges. The present invention allows operation at a frequency range of approximately 100 MHz to 18 GHz in one such embodiment, thereby allowing application in a wide variety of tests.

Moreover, the electrical specifications of the diagonal dual-polarized broadband horn antenna 500A (and the diagonal dual-polarized broadband horn antenna 500B) include an ability to maintain an average voltage standing wave ratio (VSWR) of less than 2.5:1. A ratio of the directivity gain over operating frequency of between 5 dBi to 18 dBi (decibel (referenced to isotropic radiator) is also provided. Also provided are the following: a cross-polarization isolation of greater than 25 dB, a maximum continuous power of 200 Watts, a nominal impedance of 50 Ω, two electrical connectors of SMA type, and a dual polarization symmetry of ±0.1 dB.

As mentioned above, the reduction in size, bulkiness, and weight offered by a diagonal dual-polarized broadband horn antenna permits operation at lower operating frequencies when compared to other broadband horn antennas in the art, and the availability of an integrated, shielded mounting flange makes the implementation of the diagonal dual-polarized broadband horn antenna into a test chamber or test facility even easier. The present invention provides for a solution to permit testing at lower operating frequency ranges while not compromising relative ease of movement and installation of the broadband horn antenna.

Figure 6:
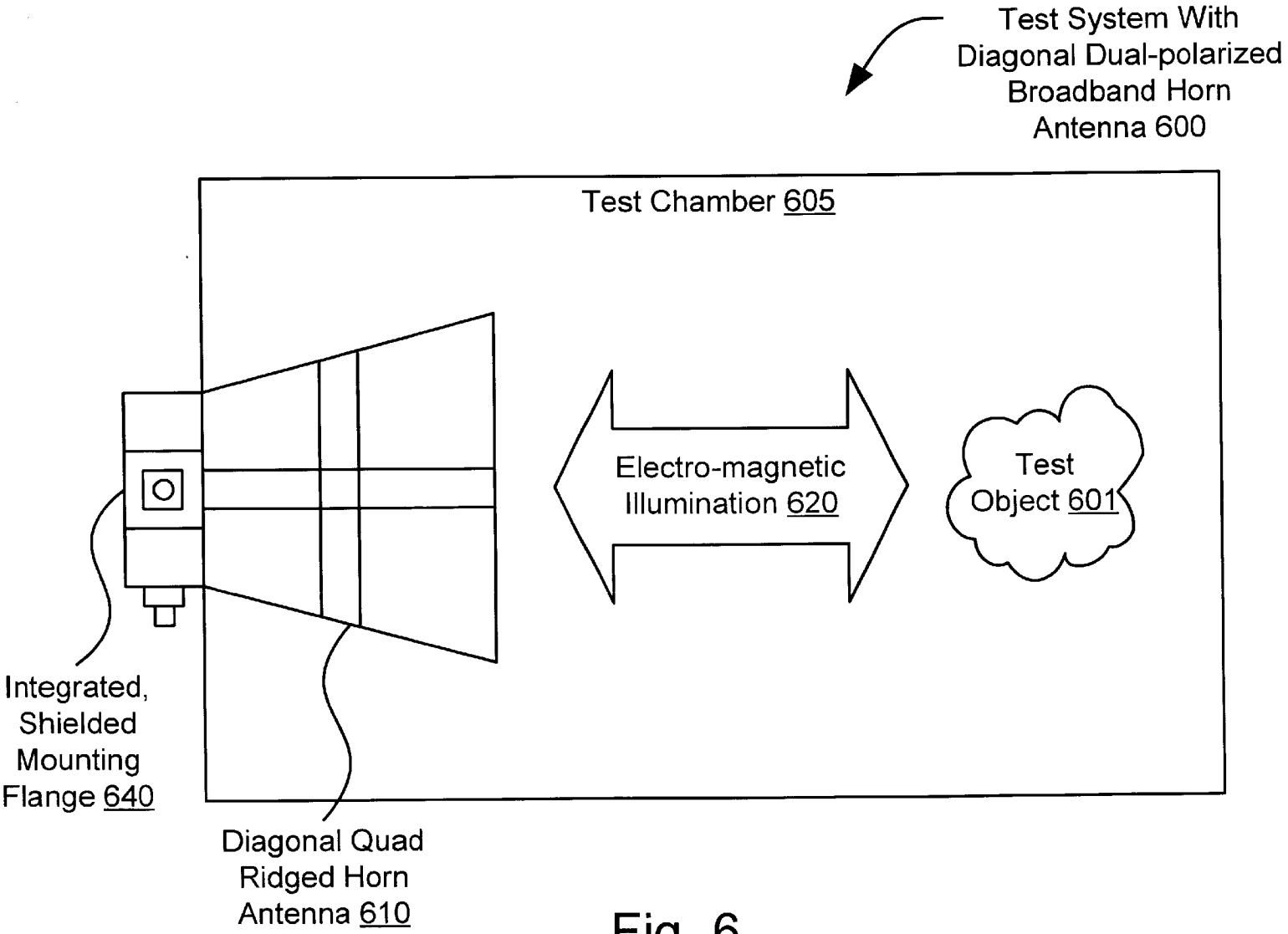
FIG. 6 is a system diagram illustrating an embodiment of a test system with a diagonal dual-polarized broadband horn antenna built in accordance with the present invention.

FIG. 6 is a system diagram illustrating an embodiment of a test system 600 with a diagonal dual-polarized broadband horn antenna 610 built in accordance with the present invention. The diagonal dual-polarized broadband horn antenna 610 is easily mounted within a test chamber 605 thanks to an integrated, shielded mounting flange 640. The test chamber 605 is a shielded anechoic test chamber in certain embodiments of the invention. The diagonal dual-polarized broadband horn antenna 610 generates electromagnetic illumination 620 that emanates from the diagonal dual-polarized broadband horn antenna 610 to test a test object 601 that is placed in the test chamber 605. The test system 600 shows the ease with which the diagonal dual-polarized broadband horn antenna 610 is integrated into test chamber 605. Any connectors that are used to energize the diagonal dual-polarized broadband horn antenna 610 may be located on the portion of the integrated, shielded mounting flange 640 that extends outside of the test chamber 605.

Figure 7:
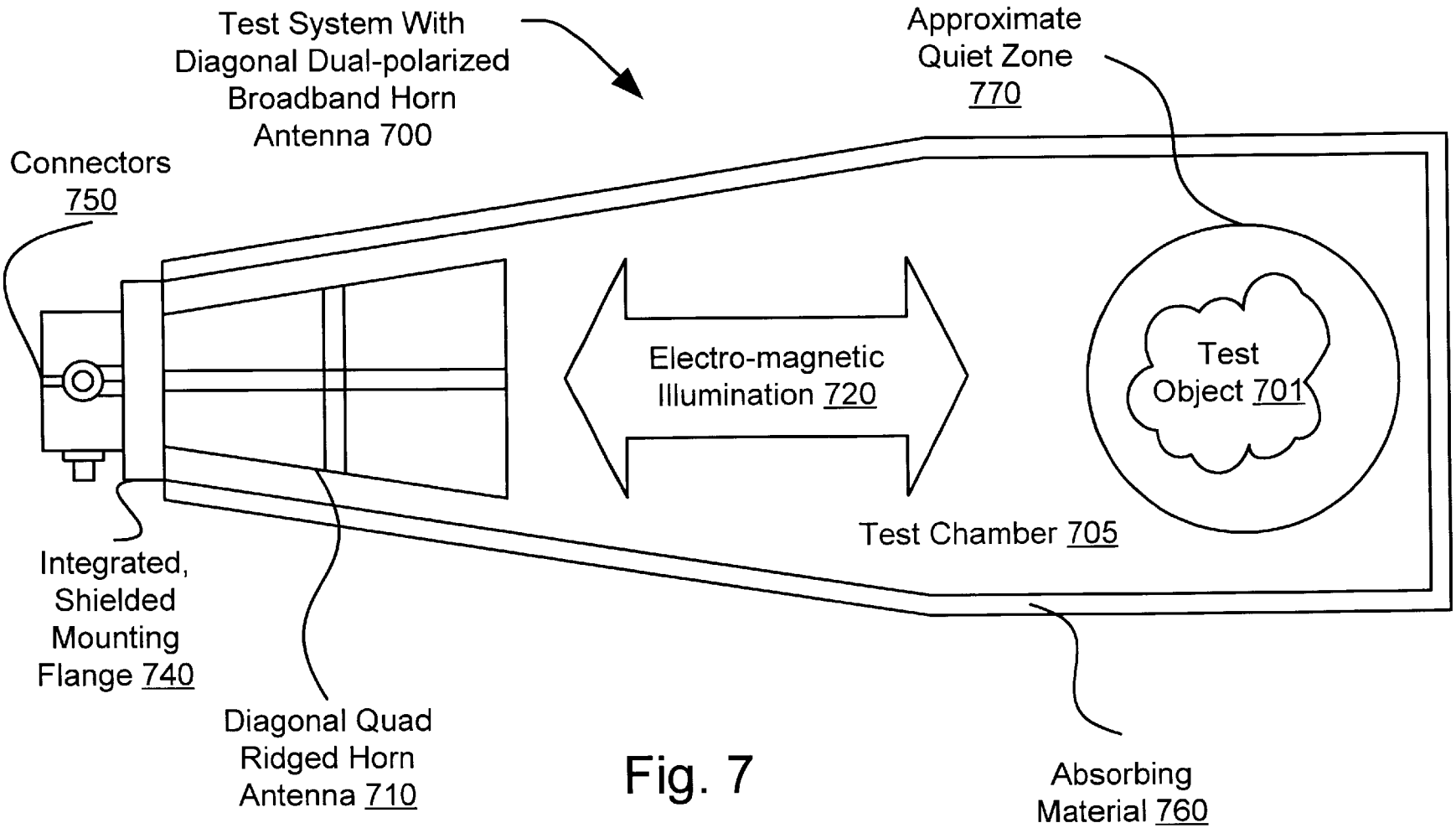
FIG. 7 is a system diagram illustrating another embodiment of a test system with a diagonal dual-polarized broadband horn antenna built in accordance with the present invention.

FIG. 7 is a system diagram illustrating another embodiment of a test system 700 with a diagonal dual-polarized broadband horn antenna 710 built in accordance with the present invention. The diagonal dual-polarized broadband horn antenna 710 is easily mounted within a test chamber 705 thanks to an integrated, shielded mounting flange 740. The test chamber 705 is a shielded anechoic test chamber in certain embodiments of the invention. The diagonal dual-polarized broadband horn antenna 710 generates electromagnetic illumination 720 that emanates from the diagonal dual-polarized broadband horn antenna 710 to test a test object 701 that is placed in the test chamber 705. The test object 701 is placed in the approximate quiet zone 770 of the test chamber 705. The test system 700 shows the ease with which the diagonal dual-polarized broadband horn antenna 710 is integrated into test chamber 705. Connectors 750, used to energize the diagonal dual-polarized broadband horn antenna 710, are located on the portion of the integrated, shielded mounting flange 740 that extends outside of the test chamber 705. A perimeter of the test chamber 705 is coated with an absorbing material 760.

A diagonal dual-polarized broadband horn antenna built in accordance with the present invention is designed for wireless test applications and covers all known wireless service frequencies. In one embodiment, the diagonal dual-polarized broadband horn antenna has two orthogonally places input feeds that permit simultaneous measurements for dual polarizations. The diagonal dual-polarized broadband horn antenna can be used as both a linearly and circularly polarized antenna over a very broad frequency range. The diagonal dual-polarized broadband horn antenna is operable as a receive antenna and also as a radiator while maintaining very high continuous power handling capability. If desired in one embodiment when the diagonal dual-polarized broadband horn antenna operates as a radiator, the maximum continuous power handling capability is approximately 200 Watts. This high radio frequency (RF) power handling capability makes the present invention operable to serve as a radiator for a wide variety of electromagnetic test applications.

In view of the above detailed description of the present invention and associated drawings, other modifications and variations will now become apparent to those skilled in the art. It should also be apparent that such other modifications and variations may be effected without departing from the spirit and scope of the present invention.

What is claimed is:

1. A diagonal dual-polarized broadband horn antenna, comprising:

a square cavity having a plurality of corners;

a diagonal line ridge located at one of the plurality of corners; and a plurality of electrical connectors, mounted on the diagonal dual-polarized broadband horn antenna, that receive a signal that is used to energize the diagonal line ridge to generate electromagnetic illumination.

2. The diagonal dual-polarized broadband horn antenna of claim 1, further comprising a tuning bar, mounted on the square cavity, that is operable to improve matching conditions of a plurality of frequencies emanating from the diagonal dual-polarized broadband horn antenna in a common direction.

3. The diagonal dual-polarized broadband horn antenna of claim 1, wherein the square cavity comprises at least one of a dielectric material and a metallic material.

4. The diagonal dual-polarized broadband horn antenna of claim 1, wherein at least one electrical connector of the plurality of electrical connectors comprises a radio frequency connector.

5. The diagonal dual-polarized broadband horn antenna of claim 1, further comprising an integrated, shielded mounting flange located at an end of the diagonal dual-polarized broadband horn antenna.

6. The diagonal dual-polarized broadband horn antenna of claim 1, wherein the diagonal line ridge comprises a smooth shape.

7. The diagonal dual-polarized broadband horn antenna of claim 1, wherein the diagonal dual-polarized broadband horn antenna is operable for installation on a shield line of a shielded anechoic test chamber.

8. A diagonal dual-polarized broadband horn antenna, comprising:

an aperture;

the aperture comprises a corner;

a diagonal line ridge that is positioned at the corner; and at least two input feeds, on a mounting flange, that are operable to permit simultaneous measurements for dual polarizations emanating from the diagonal dual-polarized broadband horn antenna.

9. The diagonal dual-polarized broadband horn antenna of claim 8, wherein the aperture further comprises three additional corners; and three additional diagonal line ridges, each of the three additional diagonal line ridges is positioned at one of the three additional corners.

10. The diagonal dual-polarized broadband horn antenna of claim 8, wherein the diagonal line ridge comprises a tapered ridge shape.

11. The diagonal dual-polarized broadband horn antenna of claim 8, further comprising:

a cavity; and a tuning bar, mounted on the cavity, that is operable to improve matching conditions for a plurality of frequencies emanating from the diagonal dual-polarized broadband horn antenna in a common direction.

12. The diagonal dual-polarized broadband horn antenna of claim 8, further comprising:

a cavity; and the cavity comprises at least one of a dielectric material and a metallic material.

13. The diagonal dual-polarized broadband horn antenna of claim 8, wherein the diagonal dual-polarized broadband horn antenna is operable for installation on a shield line of a shielded anechoic test chamber.

14. A diagonal dual-polarized broadband horn antenna, comprising:

a square cavity;

a mounting flange coupled to the square cavity; and two input feeds, on the mounting flange, that are operable to permit simultaneous measurements for dual polarizations emanating from the diagonal dual-polarized broadband horn antenna, wherein the square cavity comprises a plurality of corners; and a plurality of diagonal line ridges, each of the plurality of diagonal line ridges is positioned at one of the plurality of corners.

15. The diagonal dual-polarized broadband horn antenna of claim 14, wherein the diagonal dual-polarized broadband horn antenna is operable to generate electromagnetic illumination having a frequency range with a low end extended to approximately 100 MHz.

16. The diagonal dual-polarized broadband horn antenna of claim 14, wherein the square cavity comprises a dielectric material.

17. The diagonal dual-polarized broadband horn antenna of claim 14, further comprising a tuning bar, mounted on the square cavity, that is operable to improve a matching condition for a plurality of frequencies emanating from the diagonal dual-polarized broadband horn antenna in a common direction.

18. The diagonal dual-polarized broadband horn antenna of claim 14, wherein the diagonal dual-polarized broadband horn antenna is operable for installation on a shield line of a shielded anechoic test chamber.

* * * * *